US007434432B1

(12) United States Patent
Monsees et al.

(10) Patent No.: US 7,434,432 B1
(45) Date of Patent: Oct. 14, 2008

(54) DIE APPARATUS AND METHOD FOR HIGH TEMPERATURE FORMING OF METAL PRODUCTS

(75) Inventors: John C. Monsees, El Cajon, CA (US); Donald O. Nelepovitz, La Jolla, CA (US)

(73) Assignee: Hi-Tech Welding and Forming, Inc., El Cajon, CA (US)

( * ) Notice: Subject to any disclaimer, the term of this patent is extended or adjusted under 35 U.S.C. 154(b) by 341 days.

(21) Appl. No.: 11/207,674

(22) Filed: Aug. 18, 2005

(51) Int. Cl.
*B23P 17/00* (2006.01)
*B21D 26/02* (2006.01)

(52) U.S. Cl. ..... 72/60; 72/413; 29/421.1

(58) Field of Classification Search ..... 72/57, 72/58, 60, 413; 29/421.1
See application file for complete search history.

(56) References Cited

U.S. PATENT DOCUMENTS 3,934,441 A * 1/1976 Hamilton et al. ..... 72/60
4,984,348 A * 1/1991 Cadwell ..... 72/60
5,823,034 A 10/1998 Nelepovitz
5,974,847 A * 11/1999 Saunders et al. ..... 72/57
6,581,428 B1 * 6/2003 Friedman ..... 72/57
7,100,259 B2 * 9/2006 Morales et al. ..... 29/421.1
7,112,249 B2 * 9/2006 Schroth et al. ..... 72/57
2003/0209047 A1 11/2003 Nelepovitz

OTHER PUBLICATIONS

"Coefficients of Linear Expansion", Jul. 6, 2007, The Engineering Tool Box, www. Engineeringtoolbox.com, pp. 1 and 2.*

* cited by examiner

*Primary Examiner*—David B Jones
(74) *Attorney, Agent, or Firm*—Procopio, Cory, Hargreaves & Savitch LLP

(57) ABSTRACT

A bi-material die apparatus for high temperature forming of metal parts has at least two opposing die segments having inner surfaces together forming a hollow mold chamber for receiving a mold blank between the die segments. The die segments are of a first material having a first coefficient of thermal expansion $CTE_1$. At least one insert of a second material is associated with the inner surface of at least one of the die segments so as to project into the mold chamber, the second material having a second coefficient of thermal expansion $CTE_2$ higher than $CTE_1$ and higher than the coefficient of thermal expansion of the metal product to be formed in the cavity.

19 Claims, 4 Drawing Sheets

FIG. 2
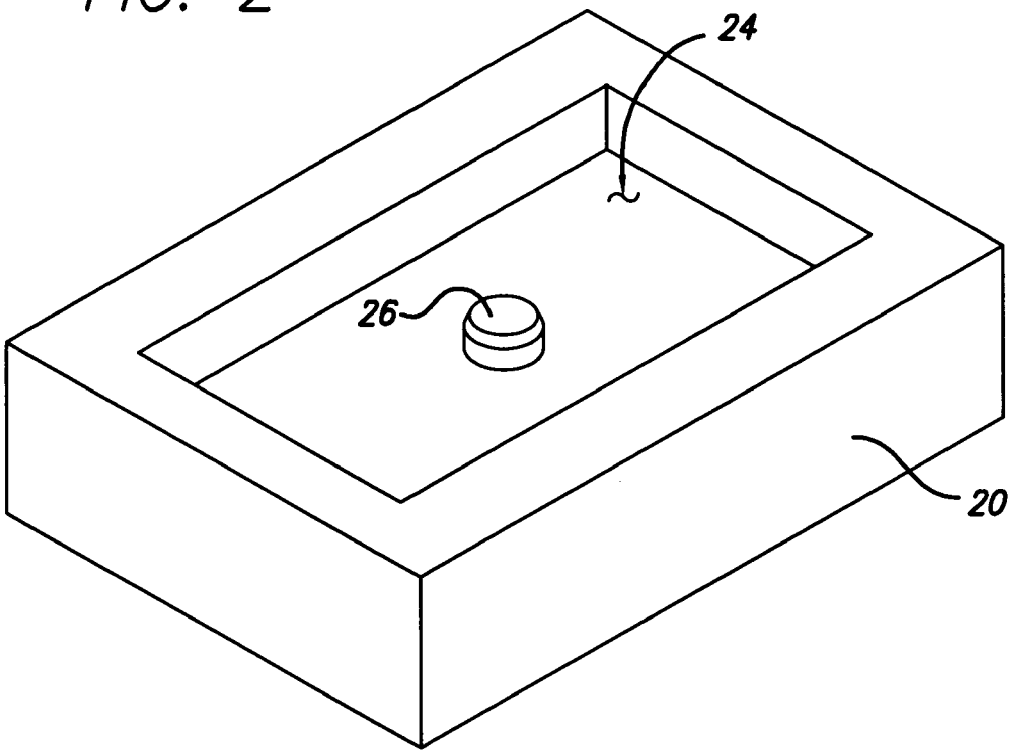
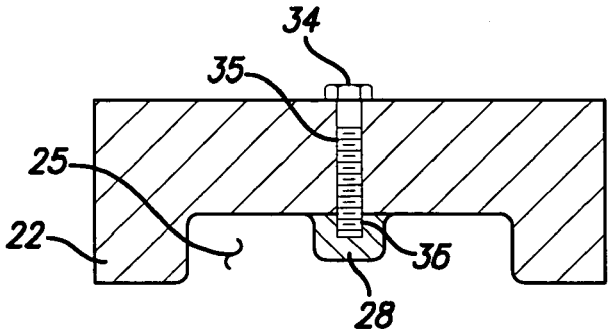
FIG. 3A
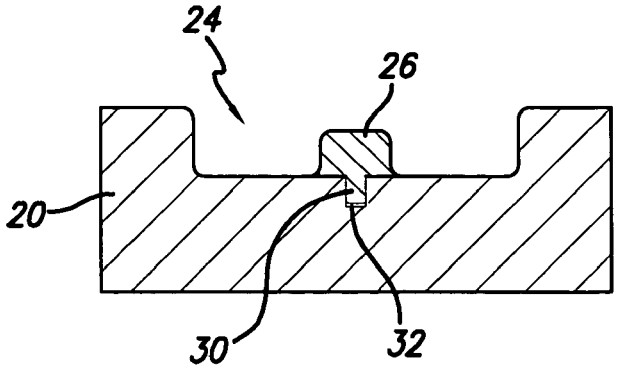
FIG. 3B

DIE APPARATUS AND METHOD FOR HIGH TEMPERATURE FORMING OF METAL PRODUCTS

BACKGROUND OF THE INVENTION

The present invention relates generally to a die apparatus and method for high temperature forming of metal products, also known as superplastic forming (SPF).

U.S. Pat. No. 5,823,034 describes a die apparatus for high temperature forming of metal parts which comprises two or more die segments of a suitable non-metallic material to form a die cavity of predetermined shape matching that of the desired part. A sheet metal blank, commonly in the form of two face-to-face sheets welded together around most of their perimeter, is positioned between the die parts and the die is then closed. The sheet metal blank is heated in the die and expanded by blowing gas into the space between the sheets, so that the heat-softened sheets superplastically expand outward and conform to the interior surface of the die. The gas is then relieved and the molded part is allowed to cool, after which the die is opened and the part is removed.

The forming die for this method is generally made of carbon/graphite, which has a relatively low coefficient of thermal expansion. The sheet metal to be formed has a relatively high coefficient of thermal expansion (CTE). As the temperature is increased, the sheet metal will expand and take the form of the forming die. Upon completion of the forming, when the assembly is cooled, the sheet metal will shrink more than the die, due to the difference in CTE between the two materials. With proper design, the sheet metal will shrink away from shapes and features in the die. This die apparatus and method is therefore adequate for simple shapes and those that do not have indentations or shaped features on the surface of the formed product. However, as new shapes are conceived for the sheet metal forming process, limitations are being reached for this basic technique to avoid binding or locking of the shaped part onto the formed features in the die. With more complex shapes, shrinkage of the sheet metal part as it cools at a faster rate than the die may cause it to lock onto features or projections in the die, damaging the forming die and making it unusable for further sheet metal forming.

SUMMARY OF THE INVENTION

It is an object of the present invention to provide a new and improved die apparatus and method for high temperature forming of metal products.

According to one aspect of the present invention, a die apparatus for forming a metal product is provided which comprises at least two opposing die segments having inner surfaces together forming a hollow mold chamber for receiving a mold blank between the die segments, the die segments being of a first material having a first coefficient of thermal expansion (CTE), and at least one insert of a second material associated with the inner surface of one of the die segments so as to project into the mold chamber, the second material having a second CTE higher than the first CTE and higher than the CTE of the metal product to be formed in the cavity.

In an exemplary embodiment, the insert is of solid metal having a relatively high CTE, such as stainless steel, high nickel alloys such as Inconel® alloys, for example Inco625 and Inco718, Hastelloy®, carbon steel, and other metals of similar high CTE. The insert is of predetermined shape to form a desired feature or indentation in the surface of the formed metal product. This avoids the problems of differential shrinkage on cooling between the metal produce and the die parts of lower CTE. With this arrangement, the solid metal insert will shrink more than the sheet metal, so that the part is released from the die and the die surface is not damaged.

The insert may be releasably mounted in the die segment in any suitable manner, for example by means of a dowel-like peg engaging in a mating bore. The peg may be provided on the insert or on the surface of the die segment. Alternatively, a fastener may extend through a bore the die segment to secure the insert in position. In one possible arrangement, a threaded bore may be provided in the insert and be aligned with the through bore in the die segment, and a threaded fastener may then extend through the bore in the die segment for threaded engagement in the bore in the insert. Inserts may also be secured in slots or grooves in the surface of the die segment, depending on the shape of the insert.

One or more inserts may be mounted in the or each die segment, depending on the shape and surface features of the part to be formed. These may be of any desired shape and dimensions, such as disc-shaped with a circular or oval periphery, rectangular or square shape, straight or contoured beam shapes, asymmetrical shapes, complex shapes with recesses, cone shapes, and the like.

According to another aspect of the invention, a method of forming a metal part under high temperature and pressure is provided, which comprises the steps of:

providing a mold blank of metal having a first coefficient of thermal expansion (CTE);

providing an openable mold of a material having a second CTE lower than the first CTE, the mold having at least two opposed die segments having inner surfaces forming a hollow mold chamber for receiving and forming the mold blank, an insert being secured to the inner surface of at least one of the die segments and having a third CTE higher than both the first CTE and the second CTE;

inserting the mold blank between the opposed die segments and closing the mold to contain the blank in the mold chamber;

heating the mold and contained blank to an operational molding temperature;

pumping pressurized gas into the heated blank and expanding the blank outwardly to conform to the shape of the inner surfaces and projecting insert;

allowing the mold and shaped blank to cool, whereby the insert shrinks to a shape of dimensions less than the formed shape in the shaped blank due to the higher CTE to release the shaped metal part from the insert; and removing the shaped metal part from the mold.

The bi-material die system of this invention allows a large variety of metal parts of various shapes to be formed at high temperatures in a superplastic metal forming procedure. This system therefore expands the usefulness of superplastic metal forming. By placing metal inserts of relatively high coefficient of thermal expansion (CTE), higher than the CTE of the sheet metal for forming the part, the formed part is more easily released from the forming die and will not tend to damage the surface of the die when it shrinks on cooling. The solid metal inserts will shrink more on cooling than the sheet metal which formed around the metal inserts under the high temperature molding conditions. This technique can be used for making any metal parts which have shapes which are likely to cause locking in a conventional, one material die.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIG. 2 is a perspective view of one part of a die apparatus according to an exemplary embodiment of the present invention;

FIG. 3 is a cross-sectional view of two opposing parts of the die apparatus of FIG. 2 in a separated condition prior to insertion of a mold blank between the die parts;

DETAILED DESCRIPTION OF THE INVENTION

Figure 1A:
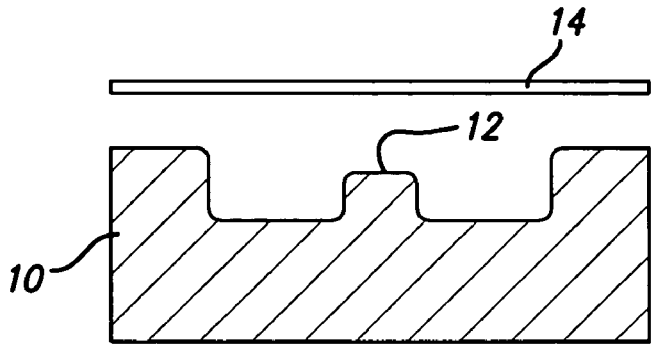
FIG. 1A PRIOR ART
FIGS. 1A to 1C illustrate steps in a prior art high temperature metal forming process.
Figure 1B:
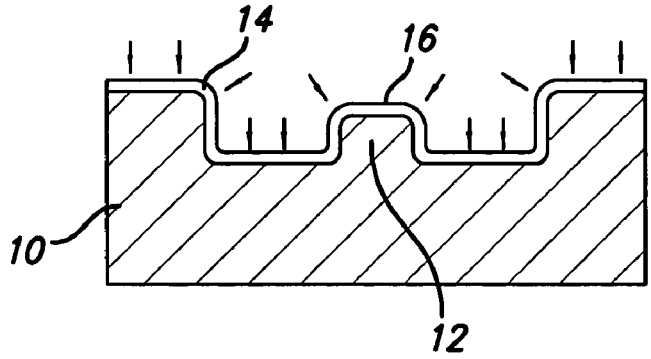
FIG. 1B PRIOR ART
Figure 1C:
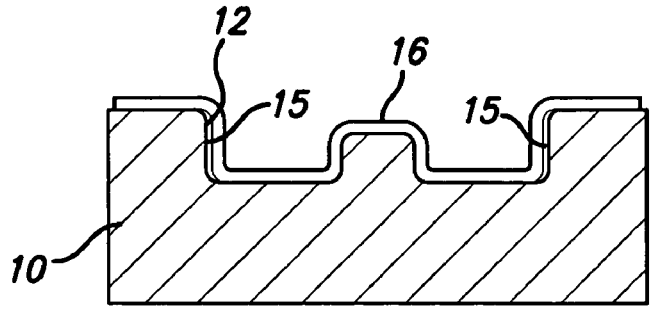
FIG. 1C PRIOR ART

FIGS. 1A to 1C illustrate a prior art high temperature or SPF (superplastic forming) molding process. Such a molding process is described in more detail in prior U.S. Pat. Nos. 5,823,034 of Nelepovitz and 6,910,359 of Nelepovitz et al., the contents of which are incorporated herein by reference.

FIG. 1A illustrates one part 10 of a forming die which is typically made of carbon/graphite material which has an extremely low coefficient of thermal expansion, or of cast ceramic material. One or more additional parts, which are not illustrated, will oppose part 10 to form a die cavity when the die is closed. The part 10 illustrated in FIG. 1A has a projection 12 on its inner surface which is intended to produce a matching indentation in the formed metal part when the process is complete. A sheet metal blank 14 is initially positioned between the die parts in the open position, as indicated in FIG. 1A.

The sheet metal blank may be two sheets of metal which are captured between the die parts when the die is closed. A gas supply tube (not illustrated) penetrates through the periphery of the blank to allow flow of pressurized gas into the space between the sheets. FIG. 1B illustrates a stage in the forming process when the die has been closed, the die and blank are heated to the forming temperature, and gas is injected into the blank, forcing the sheets against the opposing surfaces of the die cavity. FIG. 1B illustrates only one part of the die cavity with gas pressure forcing the heated sheet metal to conform against the inner surface of the die part. The sheet metal typically has a coefficient of thermal expansion much higher than that of the die material.

As the die and formed metal are allowed to cool (FIG. 1C), the sheet metal, with a higher CTE, will shrink more than the die part. This will result in gaps 15 between the formed metal sheet and the die part in some areas of the die. However, the differential shrinkage at the projection 12 will cause the shaped form 16 in the metal part to shrink around the protruding feature or insert 12, clamping tightly against this part. This makes it difficult to remove the metal part from the die, and can even damage the die and make it unusable for further sheet metal forming.

FIGS. 2 to 4 illustrate a bi-material die apparatus according to an exemplary embodiment of the present invention which allows formed metal parts to be removed more easily from the forming die at the end of the forming process. FIG. 2 illustrates one part or segment 20 of a forming die which will generally be opposed by a second, similar part 22 as indicated in FIG. 3. However, it will be understood that the die apparatus may have two or more parts depending on the application and shape of the part to be formed. FIGS. 2 to 4 illustrate the simplest case where there are two opposing die segments 20,22.

Die segment 20 has an upwardly facing forming cavity 24 of predetermined shape and dimensions while the second die segment 22 has a downwardly facing forming cavity 25 which, together with cavity 24, forms a mold chamber when the two die segments are secured together. Although the terms "upwardly" and "downwardly" are used above in connection with the orientation of the die segments in the drawings, it will be understood that the parts may be in other orientations, such as vertically oriented and facing one another.

An insert 26 of predetermined shape and dimensions is secured to the inner surface of die segment 20 so as to project into the cavity 24, while a second insert 28 of matching shape and dimensions is secured in the cavity 25 of the second die segment. It will be understood that, depending on the desired final shape of the part being formed, the second die segment may have no insert, or a different insert, and each die segment may have more than one insert in some cases. The insert 26 of FIG. 2 has an exemplary, disc-like circular shape, but it will be understand that other possible shapes may be used depending on the shape of desired features or indents in the part being formed. Some examples of alternative shapes are illustrated in FIGS. 5A to 5G and are discussed in more detail below. However, it will be understood that many other shapes are possible for inserts 26,28.

The die parts or segments are made of carbon/graphite which has a relatively low coefficient of thermal expansion. Each insert is made of solid metal having a higher coefficient of thermal expansion (CTE) than both the forming die segments and the metal sheet material to be formed in the die. If the coefficient of thermal expansion of the forming die itself is $CTE_1$, the coefficient of thermal expansion of the metal insert is $CTE_2$, and the coefficient of thermal expansion of the metal sheet material to be formed is $CTE_3$, then the relationship between these values is:

$$CTE_2 > CTE_3 > CTE_1$$

In an exemplary embodiment, the inserts are made of stainless steel. However, they may alternatively be made of any suitable metal or metal alloy having a sufficiently high CTE, such as nickel alloys (e.g. Inconel® alloys such as Inco625 and Inco718), Hastelloy®, which is a nickel-chromium-molybdenum-tungsten alloy, carbon steels, and other similar metallic materials.

FIG. 3 illustrates one example of how the inserts 26,28 are held in the respective die segments. If a die segment will be oriented facing upwardly during use, such as die segment 20, then the insert 26 may be held in position by means of a dowel pin or peg 30 which projects from an inner side of the insert 26 into a bore 32 in the inner surface of the die segment. The insert 28 in the downwardly facing die segment, or any die segment which does not face vertically upwardly, is held in place by a fastener screw or bolt 34 which extends through a through bore 35 in the die segment 22 and into an aligned, threaded bore 36 in the insert 28.

Figure 4A:
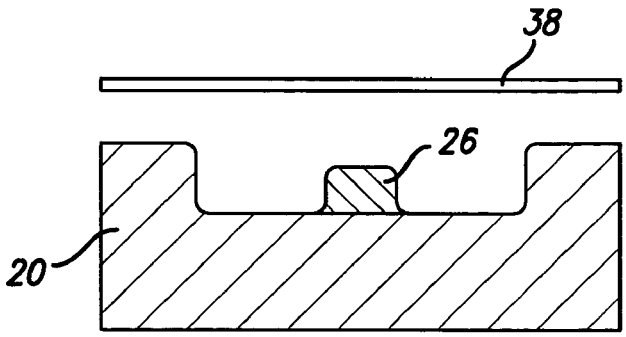
FIGS. 4A to 4C illustrate successive steps of a molding process using the die apparatus of FIGS. 2 and 3.
Figure 4B:
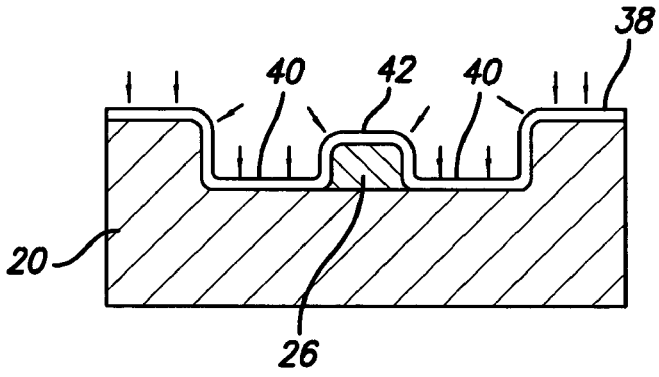
Figure 4C:
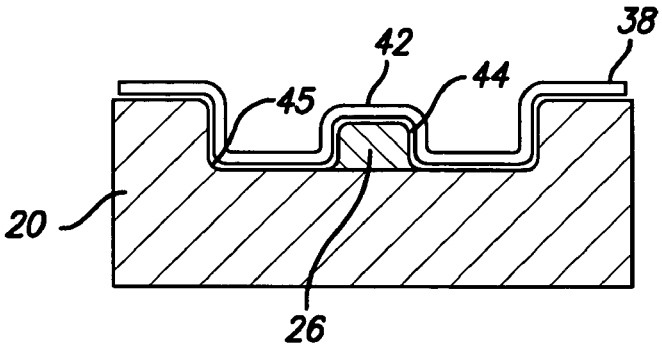

FIGS. 4A to 4C illustrate successive steps in forming a shaped metal part using the die apparatus of FIGS. 2 and 3. For convenience, only the lower part of the die is shown in the drawings, but it will be understood that the upper die segment will be clamped or locked against the lower die segment 20 as the part is formed, and the second sheet of the metal blank will be simultaneously formed against the inner surface and insert 28 of the second or upper die segment.

The die segments may be secured together by bolts or other suitable fasteners, or the die may be hinged along one side edge as described in prior U.S. Pat. No. 5,823,034 referenced above, with the opposite side edges of the die segments being latched together when the die is closed.

FIG. 4A illustrates the sheet metal blank 38 which is to be formed positioned above the die segment 20 with the die in an open condition. It will be understood that blank 38 will normally comprise two sheet metal layers secured together around their periphery, as described in U.S. Pat. Nos. 5,823,034 and 6,910,359 referenced above. Only one sheet of the blank is illustrated in FIG. 4 for convenience. The blank is clamped between the die parts, and the die is heated to the forming temperature, which is the temperature at which the metal of the blank exhibits superplasticity. In the case of many titanium alloys, this temperature is around 900° C. (1650° F.). The die heats rapidly because it is made of a material, such as graphite, which has good thermal conductivity.

A suitable gas supply and flow control system (not shown) provides pressurized gas to the interior of the sheet metal blank 38, between the two layers of the blank (only one of which is shown in FIGS. 4A to 4C). The pressure exerted by the gas (as indicated by the arrows in FIG. 4B) superplastically expands the sheet metal layers of the blank and presses them against the surfaces of the mold chamber. The metal layer 38 will therefore adopt the shape of the inner surface of die segment 20 and the insert 26, forming around the insert as indicated in FIG. 4B.

As noted above, the material of the die segment 20 has a coefficient of thermal expansion $CTE_1$, while the sheet metal blank material has a coefficient of thermal expansion $CTE_3$ and the insert 26 is of a metal having a coefficient of thermal expansion, $CTE_2$ which is higher than the first two. As the forming die, insert or inserts, and blank are heated, the die segments will expand a relatively small amount, while the sheet metal expansion will be higher than that of the die segments, and the metal insert or inserts in the die will expand the most. The sheet metal blank or layer 38 will conform to the shape of the inner surface of the die in regions 40, with a raised portion 42 conforming around the shaped insert 26.

When the metal blank has been suitably expanded, the gas pressure is relieved and the die is allowed to cool. Due to the difference in CTE between the die segments, insert, and formed part, the insert 26 will shrink more than the formed sheet metal part, as indicated in FIG. 4C, leaving a gap 44 between the insert 26 and the formed portion 42 of the part. The formed metal in regions 40 will shrink more than the adjacent surface of the die, also leaving a gap 45. This makes removal of the formed metal part from the die easy, and also avoids the risk of differential shrinkage in some regions potentially causing stress and damage to the die surface.

As has been noted above, inserts of any desired shape may be used in the die apparatus of this invention, depending on the desired surface contour of the part to be formed. The inserts 26 and 28 are removably mounted in the respective die segments, and can be replaced by inserts of different shape as desired. This apparatus and method can be used to create any shape that needs to be formed which requires features that protrude into the die cavity and which would otherwise present a potential locking problem if the features were formed integrally with the die segment itself. The shapes which are most likely to cause locking are those with parallel, flat or vertical surfaces relative to a horizontal inner die floor or surface. FIGS. 5A to 5G illustrate some alternative solid metal insert shapes which would avoid the potential locking problem. However, it will be understood that many alternative insert shapes are possible based on the desired end product shape, and such inserts may be used in forming any part requiring a feature protruding into the die cavity. It will be understood that, regardless of their shape, each insert is made of the same high CTE metal as the inserts 26,28 described above.

Figure 5A:
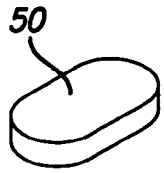
FIGS. 5A to 5G illustrate various alternative shape metal inserts for use in the die apparatus.
Figure 5B:
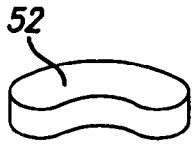
Figure 5C:
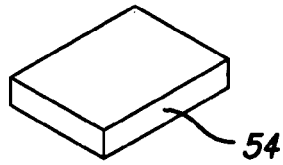
Figure 5D:
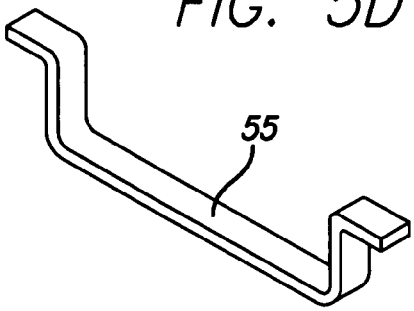
Figure 5E:
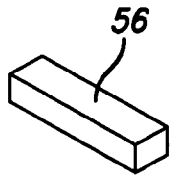
Figure 5F:
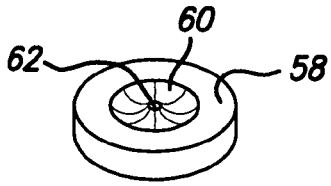
Figure 5G:
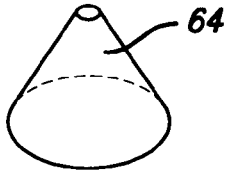

FIG. 5A illustrates an insert 50 of oval or elongated disk or puck shape. The circular and oval disk shapes of FIGS. 2 to 4 and 5A may be provided in different heights and diameters. FIG. 5B illustrates an insert 52 of asymmetrical shape. FIG. 5C illustrates an insert 54 of rectangular or square shape. FIG. 5D illustrates an insert 55 of contoured beam shape. FIG. 5E illustrates an insert 56 of straight beam shape. FIG. 5F illustrates an insert 58 which is a disk shape with a recess 60 in one face having a central peak 62. FIG. 5G illustrates an insert 64 of cone shape.

Figure 6:
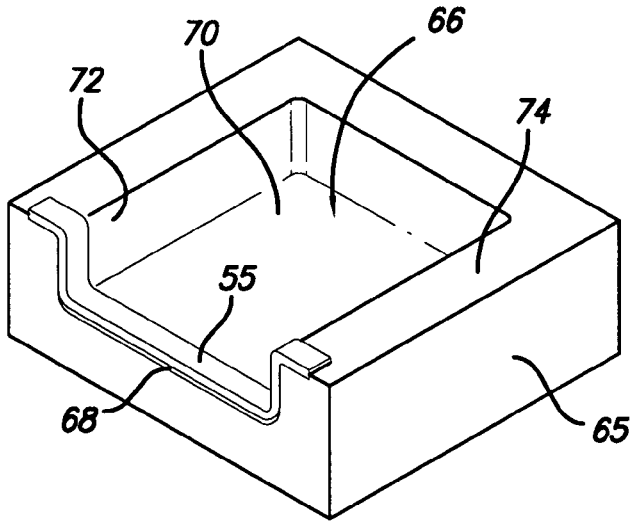
FIG. 6 is a cut away perspective view of one part of a die apparatus according to another embodiment of the invention with an embedded complex beam insert.

Inserts of beam or rib shape, such as insert 55 of FIG. 5D or insert 56 of FIG. 5E, may be mounted in suitable recesses in the respective die surface, as illustrated in FIG. 6. FIG. 6 shows a forming die segment 65 which has a die cavity 66 having a mounting groove 68 extending across its inner face 70, side faces 72, and partially across its upper rim 74. This groove matches the shape of the contoured beam insert 55 but is of reduced depth. Thus, when the beam insert 55 is mounted in the groove, it will project upwardly out of the groove by the desired amount for forming a matching shape of desired dimensions in a metal part. One or more such inserts may be mounted in the cavity, for example beam inserts may be mounted at spaced intervals along the cavity for forming a ribbed surface in a metal part. The beam insert 55 may be secured in the die cavity in a similar manner to that described above in connection with FIG. 3.

The bi-material die apparatus and method of this invention ensures that parts requiring die features which project into the cavity do not lock onto such features after high temperature forming and cooling is complete. The inserts which project into the die cavity are of a metal having a higher coefficient of thermal expansion than both the cavity itself and the sheet metal being formed. The insert will therefore shrink more than the sheet metal which is formed around it, leaving a gap to allow easy removal of the formed part. This will also avoid the risk of damage to the die surface as a result of shrinking sheet metal locking onto and applying stress to the die.

Although an exemplary embodiment of the invention has been described above by way of example only, it will be understood by those skilled in the field that modifications may be made to the disclosed embodiment without departing from the scope of the invention, which is defined by the appended claims.

What is claimed is:

1. A die apparatus for high temperature forming of a metal product of a selected shape, the apparatus comprising:

at least two opposing die segments having inner surfaces together forming a hollow mold chamber for receiving a mold blank between the die segments, the inner surface of at least a first one of the die segments having a forming surface which forms at least part of the selected metal product shape, the die segments being of a first material having a first coefficient of thermal expansion $CTE_1$; and at least one insert of a second material mounted on the forming surface of the first die segment so as to project into the mold chamber and form an indent of predetermined shape in the mold blank formed against the forming surface, the second material having a second coefficient of thermal expansion $CTE_2$ higher than $CTE_1$ and higher than the coefficient of thermal expansion $CTE_3$ of the metal product to be formed in the cavity, whereby the relationship between the coefficients of thermal expansion of the die segment, metal product to be formed, and insert is as follows: $CTE_1<CTE_3<CTE_2$;

whereby the insert shrinks to a shape of dimensions less than the formed shape of the indent in shaped metal part after forming and cooling in the mold chamber so that the shaped metal part is released from the insert.

2. The apparatus as claimed in claim 1, wherein the insert is of solid metal.

3. The apparatus as claimed in claim 1, wherein the insert is of stainless steel.

4. The apparatus as claimed in claim 1, wherein the insert is of a metal selected from the group consisting of stainless steel, carbon steel, nickel alloys, and nickel-chromium-molybdenum-tungsten alloy.

5. The apparatus as claimed in claim 1, wherein at least one insert is mounted on the inner surface of each die segment.

6. The apparatus as claimed in claim 1, wherein the insert is disk shaped.

7. The apparatus as claimed in claim 1, wherein the insert is beam shaped.

8. The apparatus as claimed in claim 1, wherein the insert is of asymmetrical shape.

9. The apparatus as claimed in claim 1, wherein the insert is of rectangular shape.

10. The apparatus as claimed in claim 1, wherein the insert is cone-shaped.

11. The apparatus as claimed in claim 1, wherein a plurality of inserts are mounted in the die segments.

12. The apparatus as claimed in claim 1, wherein the insert and the inner surface of the die segment on which the insert is mounted have interengageable formations, one of the formations comprising a dowel and the other formation comprising a slot which releasably receives the dowel.

13. A die apparatus for high temperature forming of a metal product, comprising:

at least two opposing die segments having inner surfaces together forming a hollow mold chamber for receiving a mold blank between the die segments, the die segments being of a first material having a first coefficient of thermal expansion $CTE_1$;

at least one insert of a second material associated with the inner surface of at least one of the die segments so as to project into the mold chamber, the second material having a second coefficient of thermal expansion $CTE_2$ higher than $CTE_1$ and higher than the coefficient of thermal expansion of the metal product to be formed in the cavity; and a releasable fastener which releasably positions the insert on the inner surface of the die segment.

14. The apparatus as claimed in claim 13, wherein the inner surface of the die segment has a bore and the releasable fastener comprises a pin projecting from the insert for engagement in the bore.

15. The apparatus as claimed in claim 13, wherein the insert has an inner face and a threaded bore projects inwardly from the inner face of the insert, the die segment has a through bore aligned with said threaded bore, and the fastener comprises a screw fastener extending through said through bore and threadably engaged in said threaded bore.

16. A die apparatus for high temperature forming of a metal product, comprising:

at least two opposing die segments having inner surfaces together forming a hollow mold chamber for receiving a mold blank between the die segments, the die segments being of a first material having a first coefficient of thermal expansion $CTE_1$;

at least one insert of a second material associated with the inner surface of at least one of the die segments so as to project into the mold chamber, the second material having a second coefficient of thermal expansion $CTE_2$ higher than $CTE_1$ and higher than the coefficient of thermal expansion of the metal product to be formed in the cavity; and the inner surface of the die segment has an indent and the insert is releasably mounted in said indent.

17. A method of forming a metal part under high temperature and pressure, comprising the steps of:

providing an openable mold of a material having a first coefficient of thermal expansion $CTE_1$, the mold having at least two opposed die segments having inner surfaces forming a hollow mold chamber for receiving and forming a mold blank, at least part of a first one of the inner surfaces comprising a forming surface complementary to the final shape of at least part of a metal part to be formed from the blank, an insert mounted on the forming surface of the first die segment and having a second coefficient of thermal expansion $CTE_2$ higher than $CTE_1$, whereby a combined part shaping surface is formed which comprises the forming surface and the insert and the combined shaping surface has portions having different coefficients of thermal expansion;

providing a mold blank of a metal having a third coefficient of thermal expansion $CTE_3$ greater than $CTE_1$ and lower than $CTE_2$, with the relationship between the coefficients of thermal expansion being $CTE_2>CTE_3>CTE_1$;

inserting the mold blank between the opposed die segments and closing the mold to contain the blank in the mold chamber;

heating the mold and contained blank to an operational molding temperature;

supplying pressurized gas to expand the blank outwardly to conform to the shape of the combined shaping surface formed by the first die segment and projecting insert;

allowing the mold and shaped blank to cool, whereby the insert shrinks to a shape of dimensions less than the correct formed shape in the shaped blank due to the higher coefficient of thermal expansion of the insert, whereby the shaped metal insert is released from the blank; and removing the shaped metal part from the mold.

18. The method of claim 17, further comprising mounting a second insert on the forming surface of the second die segment, the second insert having the same coefficient of thermal expansion $CTE_2$ as the first insert, the step of inserting the mold blank comprising inserting a mold blank comprising two superimposed sheets of material to be molded between the opposed die segments, and the step of pumping pressurized gas comprising pumping gas between the two sheets of mold blank material and expanding the sheets outwardly to conform to the shape of the forming surfaces and inserts of the opposed die segments.

19. A method of forming a metal part under high temperature and pressure, comprising the steps of:

releasably mounting a first insert of predetermined shape on a part shaping surface of a first die segment of an openable mold, the shaping surface and insert being of different materials, the material of the shaping surface having a first coefficient of thermal expansion $CTE_1$ and the material of the insert having a second coefficient of thermal expansion $CTE_2$ which is higher than $CTE_1$;

inserting a mold blank of a material having a third coefficient of thermal expansion $CTE_3$ between the first die segment and a second die segment of the openable mold with the mold in an open position, the relationship between the coefficients of thermal expansion being $CTE_2 > CTE_3 > CTE_1$;

closing the mold to contain the blank in a mold chamber defined between inner surfaces of the die segments;

heating the mold and contained blank to an operational molding temperature;

pumping pressurized gas into the heated blank and expanding the blank outwardly to conform to the shaping surface and insert, whereby a part is formed which corresponds to the shape of the shaping surface with an indentation corresponding in shape to the shape of the insert;

allowing the mold and shaped blank to cool, whereby the insert shrinks to a shape of dimensions less than the dimensions of the indentation formed in the shaped blank due to the higher coefficient of thermal expansion of the insert, whereby the shaped metal part is released from the insert; and removing the shaped metal part from the mold.

* * * * *